US010870905B2

(12) United States Patent
Xu et al.

(10) Patent No.: US 10,870,905 B2
(45) Date of Patent: Dec. 22, 2020

(54) LOW-COST HIGH-HEAT-CONDUCTION DIE-CASTING MAGNESIUM ALLOY AND MANUFACTURING METHOD THEREFOR

(71) Applicant: BAOSHAN IRON & STEEL CO., LTD., Shanghai (CN)

(72) Inventors: Shiwei Xu, Shanghai (CN); Jichun Dai, Shanghai (CN); Weineng Tang, Shanghai (CN); Changlong Zhuo, Shanghai (CN); Haomin Jiang, Shanghai (CN); Pijun Zhang, Shanghai (CN)

(73) Assignee: Baoshan Iron & Steel Co., Ltd., Beijing (CN)

( * ) Notice: Subject to any disclaimer, the term of this patent is extended or adjusted under 35 U.S.C. 154(b) by 163 days.

(21) Appl. No.: 15/780,161

(22) PCT Filed: Dec. 6, 2016

(86) PCT No.: PCT/CN2016/108673
§ 371 (c)(1),
(2) Date: May 30, 2018

(87) PCT Pub. No.: WO2017/101709
PCT Pub. Date: Jun. 22, 2017

(65) Prior Publication Data

US 2018/0347010 A1 Dec. 6, 2018

(30) Foreign Application Priority Data

Dec. 14, 2015 (CN) ..... 2015 1 0926273

(51) Int. Cl.
*C22C 1/02* (2006.01)
*B22D 17/00* (2006.01)
(Continued)

(52) U.S. Cl.
CPC ..... *C22C 1/02* (2013.01); *B22D 17/00* (2013.01); *B22D 27/003* (2013.01); *C22C 23/00* (2013.01); *C22C 23/04* (2013.01); *C22C 23/06* (2013.01)

(58) Field of Classification Search
CPC ..... B22D 17/00; B22D 27/003; C22C 1/02; C22C 23/00; C22C 23/06
(Continued)

(56) References Cited

U.S. PATENT DOCUMENTS 6,193,817 B1 * 2/2001 King ..... C22C 23/06 148/420
2007/0258845 A1 * 11/2007 Kondoh ..... C22C 1/0408 420/405

FOREIGN PATENT DOCUMENTS

CN 1965099 5/2007
CN 102312144 1/2012
(Continued)

OTHER PUBLICATIONS

NPL: on-line translation of CN 105088037 A, Nov. 2015 (Year: 2015).*
(Continued)

*Primary Examiner* — Jie Yang
(74) *Attorney, Agent, or Firm* — Thomas Horstemeyer, LLP

(57) ABSTRACT

A die-casting magnesium alloy. The die-casting magnesium alloy comprises, by mass percent, 1% to 5% of La, 0.5% to 3% of Zn, 0.1% to 2% of Ca, 0.1% to 1% of Mn and the balance Mg and other inevitable impurities. The die-casting magnesium alloy manufacturing method comprises smelting, refinement and die-casting. The die-casting magnesium alloy has good mechanical performance, die-casting performance and heat conduction performance.

10 Claims, 1 Drawing Sheet

(51) Int. Cl.

| | |
|---|---|
| ***C22C 23/00*** | (2006.01) |
| ***C22C 23/06*** | (2006.01) |
| ***B22D 27/00*** | (2006.01) |
| ***C22C 23/04*** | (2006.01) |

(58) Field of Classification Search
USPC ..... 148/406
See application file for complete search history.

(56) References Cited

FOREIGN PATENT DOCUMENTS

| | | | | |
|---|---|---|---|---|
| CN | 104846250 | | | 8/2015 |
| CN | 105088037 | A | * | 11/2015 |
| CN | 105401032 | | | 3/2016 |
| JP | H06200348 | | | 7/1994 |
| JP | 2008503651 | | | 2/2008 |
| KR | 19980702067 | | | 7/1998 |
| KR | 20170049083 | | | 5/2017 |

OTHER PUBLICATIONS

International Search Report and Written Opinion dated Mar. 9, 2017 for PCT Patent Application PCT/CN2016/108673.
European Search Report dated May 15, 2019 for European Patent Application 16874766.5.
Office Action dated Jan. 14, 2020 for Korean Patent Application 10-2018-7014936.
Office Action dated May 14, 2019 for Japanese Patent Application 2018528309.
Office Action dated Feb. 4, 2020 for Japanese Patent Application 2018528309.

* cited by examiner

LOW-COST HIGH-HEAT-CONDUCTION DIE-CASTING MAGNESIUM ALLOY AND MANUFACTURING METHOD THEREFOR

CROSS-REFERENCE TO RELATED APPLICATIONS

This is a national stage filing in accordance with 35 U.S.C. &371 of PCT/CN2016/108673, filed Dec. 6, 2016, which claims the benefit of the priority of Chinese Patent Application CN 201510926273.3, filed Dec. 14, 2015, the contents of each are incorporated herein by reference.

TECHNICAL FIELD

The invention relates to an alloy material and a manufacturing method therefor, in particular to a magnesium-containing alloy material and a manufacturing method therefor.

BACKGROUND ART

Magnesium and its alloys are the lightest metal structure materials with a density of only ¼ of that of steel and ⅔ of that of aluminum. Magnesium and its alloys have many advantages such as high specific strength and specific rigidity, excellent electromagnetic shielding performance, good heat dissipation property, and good vibration-reducing performance. Because pure magnesium has an extremely low strength (the tensile yield strength in the as-cast condition is only about 21 MPa) and a poor castability, and alloying is the most effective method to improve the mechanical properties and castability, magnesium alloys are used instead of pure magnesium in practical applications. In present magnesium alloy processing method, since the die-casting process has many advantages such as high production efficiency, low cost and high dimensional precision of the prepared parts, most of present magnesium alloy parts are prepared by die-casting process, i.e. 90% or more of magnesium alloy parts are die-castings pieces.

At present, shells of many 3C products (i.e. the general term for computers, communications, and consumer electronics), such as mobile phones, laptops, digital cameras, video cameras, etc. are often made of magnesium alloy die-casting. This is because the magnesium alloy has excellent thin-wall casting properties and anti-collision ability, and therefore can meet the requirements of highly integrated, lightening and thinning anti-falling, electromagnetic shielding, heat dissipation and environmental protection of 3C products. With the rapid improvement of the performance of semiconductor transistors, 3C products have become the worldwide fastest growing industries and are moving in the direction of lighter, thinner, shorter and smaller. High performance, miniaturization and integration have become the trend of development. The volumetric power density of electronic components and devices is also increasing, resulting in a significant increase in the total power density and heat generation in electronic devices such as personal computers, new high-power LED lighting systems, and high-density computer server systems. If the heat generated during the operation of the electronic devices cannot dissipate through the shell in time, the ambient temperature will rise. Meanwhile, the operating efficiency of electronic devices is highly sensitive to the temperature, i.e. the operating efficiency of some electronic devices decreases exponentially with increasing temperature. Therefore, the shells of these products and the substrates on which electronic devices such as chips are mounted need to have excellent heat dissipation performance. Hence, the low-cost magnesium alloys having thermal conductivity, die-castability, and mechanical properties can be applied in a wide range of fields.

Although the thermal conductivity of pure magnesium is high (about 157 W/m·K at room temperature), the thermal conductivity of alloyed magnesium alloys is usually significantly reduced. For example, the thermal conductivity of present commercial die-casting magnesium alloy Mg-9Al-1Zn-0.2Mn (AZ91) is only 51 W/m·K, and the thermal conductivities of Mg-5Al-0.5Mn (AM50) and Mg-6Al-0.5Mn (AM60) are 65 W/m·K and 61 W/m·K, respectively, which are much lower than that of pure Mg. Although the above-mentioned several magnesium alloys have excellent die-casting performance and good mechanical properties, they cannot meet the demand for high thermal conductivity due to their poor heat-conducting property. In addition, although magnesium alloy AE44 has excellent mechanical properties and a relatively high thermal conductivity (85 W/m·K), it tends to die sticking easily and has poor die-casting properties.

In order to meet the requirement of high thermal conductivity for magnesium alloys in the 3C manufacturing field, magnesium alloys having high thermal conductivity have also been developed successively in the prior art.

For example, Chinese Patent No. CN102719716A (published on Oct. 10, 2012) entitled "Heat conduction magnesium alloy and preparation method thereof" discloses a magnesium alloy and a preparation method thereof. The weight percentage of the chemical elements of the magnesium alloy is: Zn: 1-7%, Ca: 0.1-3%, La: 0.1-3%, Ce: 0.1-3%, and the balance is magnesium. The thermal conductivity of the magnesium alloy is not less than 125 W/m·K, the yield strength is greater than 300 MPa at room temperature, and the tensile strength is greater than 340 MPa. However, the magnesium alloy is a magnesium alloy deformed by extrusion and in which two kinds of rare earth metals are added. In addition, the patent does not involve the die-casting properties of the magnesium alloy.

For another example, Chinese Patent No. CN102251161A (published on Nov. 23, 2011) entitled "Heat conductive magnesium alloy" discloses a heat conductive magnesium alloy, comprising the components of: 0.5-5.5 wt % of Zn, 0.2-5 wt % of Sn and the balance of Mg. The magnesium alloy has a thermal conductivity of more than 110 W/m·K, a tensile strength of 180-230 MPa, and an elongation of 18-22%. However, the magnesium alloy is produced by gravity casting followed by a heat treatment process, and the patent also does not involve the die-casting properties of the magnesium alloy.

In addition, Chinese Patent No. CN102586662A (published on Jul. 18, 2012) entitled "Magnesium alloy with high thermal conductivity for die-casting" discloses a magnesium alloy with a high thermal conductivity for die-casting. The weight percentage of the chemical elements of the magnesium alloy is: 1.5-3% of lanthanides, 0.5-1.5% of one or two elements selected from aluminum and zincic, and 0.2-0.6% of one or two elements selected from manganese and zirconium, and residuals composed by the magnesium and inevitable impurities. Although the thermal conductivity of the magnesium alloy is 102-122 W/m·K, the above-mentioned patent does not involve the die-casting properties and the mechanical properties of the magnesium alloy.

Therefore, the requirements for magnesium alloy products becomes higher with the vigorous development of 3C products, resulting in an urgent need to develop a low-cost magnesium alloy that has good die-casting properties, excellent mechanical properties, and heat-conducting property.

SUMMARY OF THE INVENTION

The purpose of the present invention is to provide a low-cost high-heat-conduction die-casting magnesium alloy. The magnesium alloy material has high thermal conductivity, good die-casting properties and excellent mechanical properties. In addition, the magnesium alloy of the present invention has an economical production cost and can be extended to large-scale industrial production suitably.

In order to achieve the above purpose, present invention provides a low-cost high-heat-conduction die-casting magnesium alloy comprising, as a chemical element percentage by mass, La: 1~5%;

Zn: 0.5~3%;

Ca: 0.1~2%;

Mn: 0.1~1%;

the balance of Mg and other inevitable impurities.

The design principle of each chemical element in the low-cost high-heat-conduction die-casting magnesium alloy of the present invention is as follows:

La: rare earth element (RE) can purify the alloy melting, and can effectively improve the mechanical properties and corrosion resistance of magnesium alloy at room temperature and high temperature. In addition, rare earth elements can narrow the solidification temperature range of the alloy, thereby improving the casting performance of the alloy, and can reduce the cracking during welding and improve the compactness of the casting. Rare earth elements used for strengthening magnesium alloys commonly include gadolinium (Gd), yttrium (Y), neodymium (Nd), samarium (Sm), praseodymium (Pr), lanthanum (La), cerium (Ce) and the like. However, elements such as Gd, Y, Nd and Sm are expensive, and therefore the use of these rare earth elements will significantly increase the production costs of magnesium alloys. In contrast, Pr, La, and Ce are relatively economical rare earth elements, and La is a relatively easily available rare earth element among the three economical rare earth elements, therefore La is selected as an additive element in the alloy. When La is less than 1 wt. %, the effect on improving corrosion resistance and fluidity in the magnesium alloy is limited. Meanwhile, the additive amount of La must not be too high in order to keep the production costs at a low level. Considering the performance improvement effect and the production cost of the magnesium alloy, the La content in the low-cost high-heat-conduction die-casting magnesium alloy of the present invention should be in a range of 1-5%.

Zinc: Zn is one of the commonly used alloying elements in magnesium alloys. It has the dual functions of solution strengthening and aging strengthening. The addition of a proper amount of Zn can increase the strength and plasticity of the magnesium alloy, improve the melt fluidity, and improve the casting performance. The addition of 0.5% or more of Zn can improve the fluidity of the magnesium alloy and strengthen the mechanical properties of the alloy. However, if the additive amount of Zn is too high, the fluidity of Zn alloy will be greatly reduced and the microporosity or hot tearing of the magnesium alloy tends to occur. Therefore, based on the above technical solution, the content of Zn is controlled in the range of 0.5-3%.

Calcium: since the addition of alkaline earth element Ca can advantageously improve the metallurgical quality of magnesium alloys and the cost of adding Ca is relatively low, Ca is often added in the production process of magnesium alloys. Reasons for adding Ca are: 1) to increase the ignition temperature of magnesium alloy melts and reduce the oxidation of the melt in the smelting process and the alloy during the heat treatment, in particular, a small amount of Ca (for example, 0.1 wt. % of Ca) can improve the oxidation resistance and heat resistance of magnesium alloys; 2) Ca can refine the magnesium alloy grains and improve the corrosion resistance and creep resistance of magnesium alloys. In view of this, the content of Ca in the low-cost high-heat-conduction die-casting magnesium alloy of the present invention needs to be designed to be 0.1-2%.

Manganese: Since magnesium alloys are chemically active, they are easily corroded. Furthermore, since most of the tools used for smelting, such as crucible and mixing tools, are ferruginous, magnesium alloys often contain impurities such as Fe and Cu in a relatively large amount. These impurities will further severely deteriorate the corrosion resistance of magnesium alloys. The corrosion resistance of magnesium alloy can be improved by adding Mn element. A small amount of Mn forms Fe—Mn compounds with the impurity element Fe, thereby reducing the toxicity of impurity elements and improving the corrosion resistance of the alloy. In addition, Mn can slightly increase the yield strength and weldability of magnesium alloys, and has the effect of refining the alloy grains. The Mn content in the low-cost high-heat-conduction die-casting magnesium alloy of the present invention should be set to 0.1-1%.

Because Al greatly reduces the thermal conductivity of magnesium alloys, the Al alloy element is not added in the magnesium alloy of the present invention, which is different from the prior art magnesium alloy material using Al for alloy addition, to improve the thermal conductivity of the magnesium alloy material.

Further, the low-cost high-heat-conduction die-casting magnesium alloy has a microstructure comprising α-magnesium matrix and precipitation phase, and wherein the α-magnesium matrix comprises fine grains and a small amount of relatively larger grains, and the relatively larger grains have a volume ratio of 20% or less.

Further, the fine grains have a size of 3-15 μm and the relatively larger grains have a size of 40-100 μm.

In present technical solution, the fine α-magnesium matrix effectively improves the mechanical properties of die-casting magnesium alloys.

Further, the precipitation phases comprise a Mg—Zn—La—Ca quaternary phase that is continuously distributed around grain boundaries and a Mg—Zn phase precipitated inside the grains.

Further, the Mg—Zn phase has a width of 1-20 nm and a length of 10-1000 nm.

In present technical solution, the Mg—Zn—La—Ca quaternary phase effectively improves the mechanical properties and creep resistance of the alloys, and the Mg—Zn phase reduces the content of Zn solid solution in α-magnesium matrix, weakens the effect of alloying elements on heat-conducting property, and improves the mechanical properties of the alloys.

Therefore, a die-casting magnesium alloy with above microstructures has better mechanical properties and heat-conducting property.

Further, the low-cost high-heat-conduction die-casting magnesium alloy of the present invention has a thermal conductivity of 110 W/m·K or more, a tensile strength of 200-270 MPa, a yield strength of 150-190 MPa, and an elongation of 2-10%.

Another purpose of the present invention is to provide a manufacturing method for low-cost high-heat-conduction die-casting magnesium alloys. According to such manufacturing method, a magnesium alloy with good die-casting properties, excellent comprehensive mechanical properties, and high thermal conductivity can be obtained. In addition, the manufacturing method uses a die-casting process, which has simple production process and economical production costs.

In order to achieve the above purpose, present invention provides a manufacturing method for low-cost high-heat-conduction die-casting magnesium alloys, comprising the following steps:

(1) melting pure Mg ingots and pure Zn ingots in a smelting furnace;

(2) adding Mg—Ca and Mg—Mn master alloys to the smelting furnace and melting them completely;

(3) adding Mg—La master alloy to the smelting furnace and melting it completely, and adding flux at the same time to cover the surface of a resulting melt;

(4) refining the melt with the flux;

(5) cooling the refined melt to 630-750° C.;

(6) die-casting the melt to obtain a low-cost high-heat-conduction die-casting magnesium alloy.

As can be seen from the above process steps, the manufacturing method for the low-cost high-heat-conduction die-casting magnesium alloy of the present invention is characterized in that die-casting process is used in the production process to obtain the magnesium alloy of the invention.

In present technical solution, the flux may be a commercially available RJ-5 magnesium alloy flux (RJ-5, a standard product in magnesium alloy industry, main components are 24-30 wt. % of $MgCl_2$, 20-26 wt. % of KCl, 28-31 wt. % of $BaCl_2$, 13-15 wt. % of $CaF_2$), and may also be other magnesium alloy flux commonly used in the art.

Further, in above step (1), smelting temperature is controlled to 700-760° C., and the smelting is performed under the protection of $SF_6$ gas.

Further, in above step (2), smelting temperature is controlled to 700-760° C., and the smelting is performed under the protection of $SF_6$ gas.

Further, in above step (3), smelting temperature is controlled to 700-760° C., and the smelting is performed under the protection of $SF_6$ gas.

Further, in above step (4) smelting temperature is controlled to 730-780° C., and Ar gas is introduced into the melt or the melt is manually stirred, while RJ-5 flux is simultaneously added for refining for 5-15 minutes to obtain a refined melt; and then the refined melt is kept standing at 730-760° C. for 80-120 minutes.

In above technical solutions, the introduction of Ar gas into the melt and the manual stirring of the melt both aim to stir the melt.

Further, in the step (6), the die-casting is controlled such that an injection speed is 2-50 m/s, a die temperature is 220-400° C., and a casting pressure is 10-90 MPa.

The low-cost high-heat-conduction die-casting magnesium alloy of the present invention has a reasonable and economical composition design, i.e. avoids the addition of relatively expensive rare earth alloy elements but a relatively economical rare earth alloy element La. Besides, the die-casting process in a production process is optimized to improve comprehensive mechanical properties, die-casting properties and thermal conductivity of magnesium alloys.

The low-cost high-heat-conduction die-casting magnesium alloy of the present invention has a high tensile strength (i.e. 200-270 MPa) and high yield strength (i.e. 150-190 MPa).

In addition, the magnesium alloy of the present invention has a good heat-conducting property with a thermal conductivity of 110 W/m·K or more.

In addition, the magnesium alloy of the present invention has a good elongation with an elongation of 2%-10%.

Besides, the magnesium alloy of the present invention has good fluidity and good die-casting property.

The magnesium alloy of the present invention has an economical cost in alloy addition and a low production cost.

Through the manufacturing method for the low-cost high-heat-conduction die-casting magnesium alloy of the present invention, a magnesium alloy with high strength, good heat-conducting property, good tensile elongation property and good die-casting property can be obtained.

DETAILED DESCRIPTION

Figure 1:
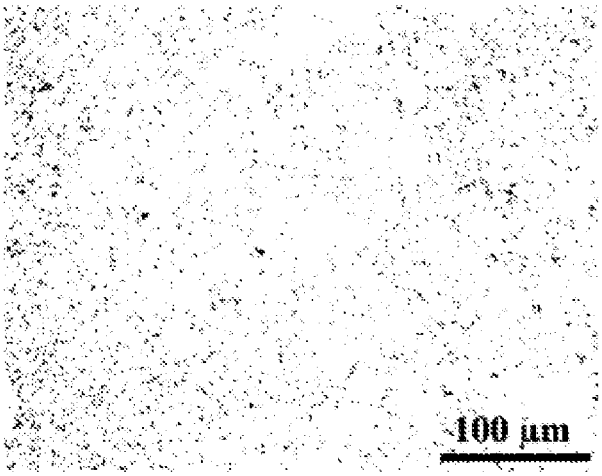
FIG. 1 is a figure shows the optical microstructure of the low-cost high-heat-conduction die-casting magnesium alloy of Example E.

The low-cost high-heat-conduction die-casting magnesium alloy of the present invention and the manufacturing method therefor will be further explained with reference to the accompanying drawings and specific Examples, while the technical solutions of the present invention are not limited by the explanations.

EXAMPLES A-E AND COMPARATIVE EXAMPLE F

The above Examples and Comparative Example are obtained by the manufacturing method for the low-cost high-heat-conduction die-casting magnesium alloy of the present invention, including the steps of:

1) melting pure Mg ingots and pure Zn ingots in a smelting furnace under the protection of $SF_6$ gas, wherein smelting temperature is controlled to 700-760° C.;

2) adding Mg—Ca and Mg—Mn master alloys to the smelting furnace and melting completely under the protection of $SF_6$ gas, wherein smelting temperature is controlled to 700-760° C.;

3) adding Mg—La master alloy to the smelting furnace and melting completely under the protection of $SF_6$ gas, wherein smelting temperature is controlled to 700-760° C., and adding flux RJ-5 at the same time to cover melt surface;

4) refining the melt, wherein smelting temperature is controlled to 730-780° C., introducing Ar gas into the melt while adding RJ-5 flux for refining for 5-15 minutes to obtain a refined melt; then standing at 730-760° C. for 80-120 minutes and controlling the mass percentage of chemical elements in the melt to the values as shown in Table 1;

5) cooling the refined melt to 630-750° C. to obtain a melt for die-casting.

6) die-casting the melt by a 300-ton cold chamber die casting machine to obtain low-cost high-heat-conduction die-casting magnesium alloys of different sizes, wherein the die-casting parameters are controlled as: the shot speed for injecting the melt for die-casting in step (5) into the die-casting machine is 2-50 m/s, die temperature is 220-400° C., and casting pressure is 10-90 MPa.

Table 1 shows the mass percentages of the chemical elements of magnesium alloys of the above Examples and Comparative Example.

TABLE 1

(wt %, the balance are Mg and other inevitable impurities)

| Number | La | Zn | Ca | Mn | Die-casting size |
|---|---|---|---|---|---|
| A | 5 | 0.5 | 2 | 0.1 | 150 mm × 50 mm × 2 mm |
| B | 1 | 3 | 0.1 | 0.5 | 100 mm × 40 mm × 1 mm |
| C | 4 | 2 | 1 | 1 | 100 mm × 40 mm × 1 mm |
| D | 2 | 2.5 | 1 | 0.5 | 1000 mm × 50 mm × 0.6 mm |
| E | 5 | 0.5 | 0.5 | 0.9 | 1200 mm × 50 mm × 0.6 mm |
| F | 5 | 0.5 | — | 0.9 | 1200 mm × 50 mm × 0.6 mm |

Table 2 shows specific process parameters of the manufacturing method for magnesium alloys of the above Examples and Comparative Example.

TABLE 2

| | Step (1) | Step (2) | Step (3) | Step (4) | | | | Step (5) temperature | Step (6) | | |
|---|---|---|---|---|---|---|---|---|---|---|---|
| Number | smelting temperature (° C.) | smelting temperature (° C.) | smelting temperature (° C.) | furnace temperature (° C.) | refining time (min) | standing temperature (° C.) | standing time (min) | after cooling (° C.) | shot speed (m/s) | die temperature (° C.) | casting pressure (MPa) |
| A | 720 | 740 | 740 | 780 | 5 | 750 | 80 | 630 | 50 | 230 | 12 |
| B | 740 | 760 | 720 | 760 | 10 | 740 | 80 | 650 | 15 | 400 | 80 |
| C | 740 | 760 | 720 | 760 | 10 | 740 | 100 | 750 | 3 | 300 | 50 |
| D | 750 | 750 | 730 | 760 | 15 | 740 | 120 | 700 | 10 | 260 | 20 |
| E | 760 | 760 | 740 | 750 | 15 | 750 | 120 | 720 | 6 | 240 | 10 |
| F | 760 | 760 | 740 | 750 | 15 | 750 | 120 | 720 | 6 | 240 | 10 |

Magnesium alloy samples of Examples A-E and Comparative Example F were tested. In addition, the ignition point and creep performance tests were also conducted for Example E and Comparative Example F. The test results are shown in Table 3.

Table 3 shows the overall performance parameters of the magnesium alloys of the above Examples and Comparative Example.

TABLE 3

| Number | Thermal conductivity W/(m · K) | Tensile strength (MPa) | Yield strength (MPa) | Elongation (%) | Die casting surface with or without defects | Ignition point (° C.) | Steady creep rate at 200° C./60 MPa |
|---|---|---|---|---|---|---|---|
| A | 130 | 260 | 185 | 4% | without defects | — | — |
| B | 115 | 280 | 195 | 10% | without defects | — | — |
| C | 120 | 270 | 170 | 2% | without defects | — | — |
| D | 115 | 275 | 174 | 5% | without defects | — | — |
| E | 115 | 280 | 170 | 6% | without defects | 847 | $1.4 \times 10^{-7}$ $s^{-1}$ |
| F | 110 | 274 | 162 | 7.6% | without defects | 764 | $2.5 \times 10^{-6}$ $s^{-1}$ |

As can be seen from Table 3, all magnesium alloys of Examples A to E of the present invention have a tensile strength of 260 MPa or more, a yield strength of 170 MPa or more and an elongation of 2% or more. Therefore, the magnesium alloys of Examples have comprehensive mechanical properties such as high strength and good tensile elongation property. In addition, thermal conductivities of all the magnesium alloys of Examples A to E of the present invention are 115 W/(m·K) or more, indicating the excellent thermal conductivity of the magnesium alloys of the above Examples.

As can be seen from the combination of Table 1, Table 2 and Table 3, although same manufacturing process parameters were used for Example E and Comparative Example F, the thermal conductivity of Comparative Example F (i.e. 110 W/(m·K)) was lower than that of Example E, the ignition point (the ignition point characterizes the degree of difficulty of oxidation and combustion of the alloy in the smelting process, i.e. the higher ignition point an alloy has, the less likely it is oxidized and combusted during the smelting process, while the lower ignition point an alloy has, the more likely it is oxidized and combusted) of Comparative Example F (i.e. 764 (° C.)) was also lower than that of Example E, while the steady creep rate at 200° C./60 MPa (the steady creep rate characterizes the deformation rate of the alloy when subjected to external loads for a long time at high temperature, i.e. the lower creep rate an alloy has, the less likely the alloy deforms at high temperature and the better the stability of the alloy become, otherwise, the alloy tends to deform at high temperature have a poor stability) of Comparative Example F (i.e. $2.5\times10^{-6}$ $S^{-1}$) was higher than that of Example E, since Comparative Example F did not include Ca. Thus, the above demonstrates that the addition of Ca can effectively improve the ignition point and creep resistance of the alloy.

Figure 2:
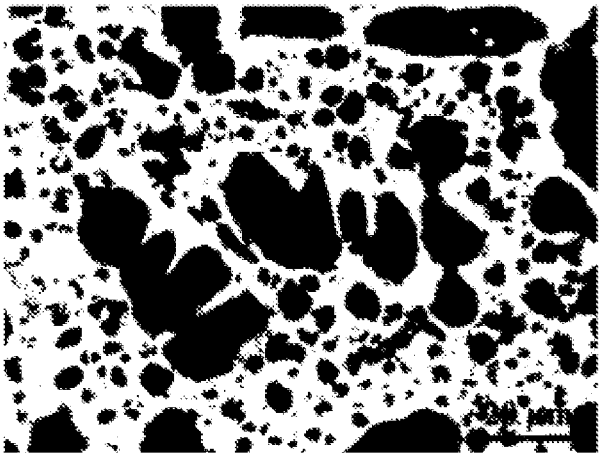
FIG. 2 is a scanning electron micrograph of the microstructure of the low-cost high-heat-conduction die-casting magnesium alloy of Example E.
Figure 3:
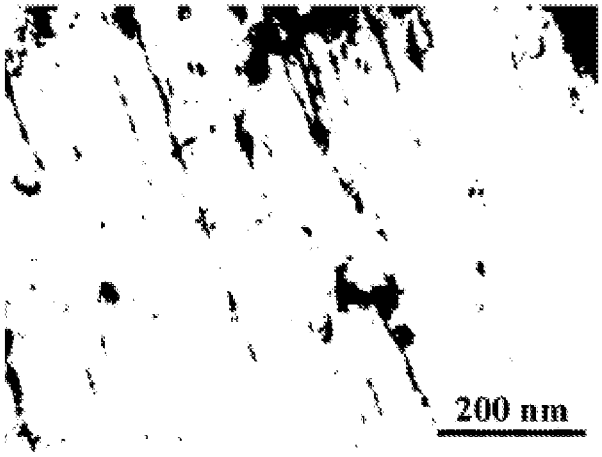
FIG. 3 is a transmission electron micrograph of the microstructure of the low-cost high-heat-conduction die-casting magnesium alloy of Example E.

FIGS. 1, 2 and 3 show the optical micrograph, the scanning electron micrograph and the transmission electron micrograph of the low-cost high-heat-conduction die-casting magnesium alloy of Example E, respectively. It can be seen from FIG. 1 that the α-Mg matrix of the low-cost high-heat-conduction die-casting magnesium alloy mostly forms fine grains with grain sizes of 3-15 μm, while only a small amount of large crystal grains having sizes of 40-100 μm are present. As can be seen from FIG. 2, there are many second phases (precipitate phase) distributed at the grain boundary. These phases can also effectively improve the mechanical properties and creep resistance of the alloy. These phases are distributed in a continuous manner around the grain boundary. The energy spectrum analysis results show that these second phases are Mg—Zn—La—Ca quaternary phase. As can be seen from FIG. 3, there are also precipitated phases inside the grains, which have a width of 1-20 nm and a length ranging from 10-1000 nm. The energy spectrum analysis shows that these phases are Mg—Zn phase, which reduces the Zn content in the Mg matrix, weakens the effect of alloying elements on the thermal conductivity, and improves the mechanical properties of the alloy.

It should be noted that the above is only specific Examples of the present invention. It is obvious that present invention is not limited to the above Examples, and there are many similar changes. All variations that a person skilled in the art derives or associates directly from the disclosure of the present invention shall fall within the protection scope of the present invention.

The invention claimed is:

1. A heat-conduction die-casting magnesium alloy consisting of by mass,

La: 1 to 5%;

Zn: 2.5 to 3%;

Ca: 0.1 to 2%;

Mn: 0.1 to 1%; and the balance is Mg and other inevitable impurities;

wherein the magnesium alloy has a microstructure comprising α-magnesium matrix and precipitation phases, and wherein the α-magnesium matrix comprises fine grains and a small amount of relatively larger grains, and the relatively larger grains have a volume ratio of 20% or less; and wherein the fine grains have a size of 3-15 μm and the relatively larger grains have a size of 40-100 μm.

2. The heat-conduction die-casting magnesium alloy of claim 1, wherein the precipitation phases comprises a Mg—Zn—La—Ca quaternary phase that is continuously distributed around grain boundaries and a Mg—Zn phase precipitated inside the grains.

3. The heat-conduction die-casting magnesium alloy of claim 2, wherein the Mg—Zn phase has a width of 1-20 nm and a length of 10-1000 nm.

4. The heat-conduction die-casting magnesium alloy of claim 1, wherein the magnesium alloy has a thermal conductivity of 110 W/m·K or more, a tensile strength of 200-270 MPa, a yield strength of 150-190 MPa, and an elongation of 2-10%.

5. A manufacturing method for a heat-conduction die-casting magnesium alloy, comprising the following steps:

(1) melting pure Mg ingots and pure Zn ingots in a smelting furnace;

(2) adding Mg—Ca and Mg—Mn master alloys to the smelting furnace and melting them completely;

(3) adding Mg—La master alloy to the smelting furnace and melting it completely, and adding flux at the same time to cover the surface of a resulting melt;

(4) refining the melt;

(5) cooling the refined melt to 630-750° C.; and (6) die-casting the melt to obtain a heat-conduction die-casting magnesium alloy consisting of by mass:

La: 1 to 5%;

Zn: 2.5 to 3%;

Ca: 0.1 to 2%;

Mn: 0.1 to 1%; and the balance is Mg and other inevitable impurities;

wherein the magnesium alloy has a microstructure comprising α-magnesium matrix and precipitation phases, and wherein the α-magnesium matrix comprises fine grains and a small amount of relatively larger grains, and the relatively larger grains have a volume ratio of 20% or less; and wherein the fine grains have a size of 3-15 μm and the relatively larger grains have a size of 40-100 μm.

6. The manufacturing method for the heat-conduction die-casting magnesium alloy of claim 5, wherein in the step (1), temperature in the smelting furnace is controlled to 700-760° C., and the melting is performed under the protection of $SF_6$ gas.

7. The manufacturing method for the heat-conduction die-casting magnesium alloy of claim 5, wherein in the step (2), temperature in the smelting furnace is controlled to 700-760° C., and the melting is performed under the protection of $SF_6$ gas.

8. The manufacturing method for the heat-conduction die-casting magnesium alloy of claim 5, wherein in the step (3), temperature in the smelting furnace is controlled to 700-760° C., and the smelting is performed under the protection of $SF_6$ gas.

9. The manufacturing method for the heat-conduction die-casting magnesium alloy of claim 5, wherein in the step (4), temperature in the smelting furnace is controlled to 730-780° C., and Ar gas is introduced into the melt or the melt is manually stirred, while flux is simultaneously added for refining for 5-15 minutes to obtain a refined melt; and then the refined melt is kept standing at 730-760° C. for 80-120 minutes.

10. The manufacturing method for the heat-conduction die-casting magnesium alloy of claim 5, wherein in the step (6), the die-casting is controlled such that an injection speed is 2-50 m/s, a die temperature is 220-400° C., and a casting pressure is 10-90 MPa.

* * * * *